United States Patent [19]

Eagle

[11] Patent Number: 4,919,747

[45] Date of Patent: Apr. 24, 1990

[54] LABEL APPLYING DEVICES FOR APPLYING ADHESIVE LABELS TO ARTICLES

[75] Inventor: Christopher R. Eagle, Harwich, United Kingdom

[73] Assignee: Portals Engineering Limited, Harwich, United Kingdom

[21] Appl. No.: 271,315

[22] Filed: Nov. 15, 1988

[51] Int. Cl.[5] ..... B65C 9/14; B65C 9/28

[52] U.S. Cl. ..... 156/497; 156/571; 156/572; 156/DIG. 31; 156/DIG. 38; 271/95; 271/185

[58] Field of Search ..... 156/571, 572, DIG. 31, 156/DIG. 29, DIG. 33, DIG. 38, DIG. 42, 497; 271/95, 185

[56] References Cited

U.S. PATENT DOCUMENTS

| | | | |
|---|---|---|---|
| 3,616,094 | 10/1971 | Navin et al. | 156/571 |
| 4,124,436 | 11/1978 | Pettis, Jr. et al. | 156/542 |
| 4,425,181 | 1/1984 | Bahr et al. | 156/497 |
| 4,595,447 | 6/1986 | Lindstrom | 156/571 |
| 4,612,079 | 9/1986 | Ostrow | 156/497 |

FOREIGN PATENT DOCUMENTS

| | | | |
|---|---|---|---|
| 814311 | 6/1959 | United Kingdom . | |
| 941161 | 11/1963 | United Kingdom | 156/DIG. 31 |

*Primary Examiner*—Michael Wityshyn
*Attorney, Agent, or Firm*—Beveridge, DeGrandi & Weilacher

[57] ABSTRACT

The disclosure relates to a labelling mechanism for a weigh/price labelling apparatus comprising a device (10) which supplies printed self-adhesive labels on a backing strip (11) around a stripper block (12) to feed labels onto a temporary holder (13) on which a label is held by vacuum ports in the holder. A label transfer device (16) comprises a carrier (17) mounted for rotary movement on an eccentric drive mechanism (18). Rotation of the drive mechanism moves the carrier (17) from a label receiving position adjacent the holder (13) to a label delivery position for delivering a label to an article. The carrier includes a pad (42) having ports (47) to which vacuum or air pressure can be supplied to hold a label to or discharge a label from the pad.

In order to reorientate the label between the pick-up and discharge positions, the pad is mounted on a spindle (43) which is reciprocated in opposite directions by means of two pneumatically operatable piston/rack members (46) movable in bores (45) in the mounting block for the pads. The stroke of the pistons can be adjusted so that the pad can be orientated as required to suit the article to which the label is to be applied.

7 Claims, 3 Drawing Sheets

LABEL APPLYING DEVICES FOR APPLYING ADHESIVE LABELS TO ARTICLES

BACKGROUND OF THE INVENTION

1. Field of the Invention

This invention relates to label applying devices for applying adhesive labels to articles and is particularly, although not exclusively applicable to label applying devices for labeling apparatus of weigh/price labeling machines in which articles (usually food items) are delivered by a conveyor to a weigh station where they are weighed and then to a labeling station where a label printed with the weight and price computed from the measured weight and other information such as date dates, goods description and appropriate bar codes is applied to the article.

2. Background Prior Art

U.S. Pat. No. 3,616,094 discloses such a label applying device in which a pickup assembly removes labels from a label-printing machine and affixes the labels on a prewrapped package as a different angular relation to the package than when picked up from the label-printing machine. The assembly includes a vacuum pickup tube rotatable through 180° to pick up a label from the printing machine and move the label to a transfer position. A vacuum nozzle is rotatably supported on the pickup tube and has a cam follower positioned to engage a downwardly inclined cam on the downward motion of the pickup to the transfer position to rotate the labels through a predetermined angle and a label pickup pad to remove the label from the vacuum nozzle at the transfer position and affix the label to the prewrapped package. Thus the label is received from the printing machine by the pickup assembly at a first position, moved to a second position and, in so doing, is rotated through an angle of 180° and, at the second position, is transferred to a pick pad which then moves the label to a further position at which it is applied to the package.

U.S. Pat. No. 4,124,436 discloses a label applying apparatus in which a label is rotated through a desired number of degrees of rotation before its application to an article in order that the label may be applied in a preferred orientation. A label dispenser delivers the label to a first vacuum foot which holds the label substantially parallel to the surface of the article upon which the label is to be placed. The label is then transferred to a second, reciprocating vacuum foot which rotates while it moves into contact with the article. Again the first transfer of the label is to an intermediate holding device from which the label is transferred to a second device which rotates the label and applies it to the package.

UK patent specification No. 814311 discloses a labeling machine having a carrier in the form of a narrow drum with space sets of suction ports around the drum for holding labels thereto. One port in each set is rotatable through a mechanical cam operated mechanism whilst the other ports are rendered inoperative to rotate the label with respect to the drum during the movement of the label from a gummer applying position to a position in which the label is applied to an article.

U.S. Pat. No. 4,425,181 discloses an apparatus for simultaneously applying individual "outserts" to multiple containers of pharmaceuticals. The containers are advanced along a conveyor and are stopped in groups by a gate assembly opposite to a transfer assembly including a rotatable pickup arm mounted for reciprocation between a retractor position adjacent a magazine containing the outserts and an extended position adjacent to container input path. Vacuum cups are provided from the pickup arm for engaging the outserts and pin and drive pin arrangement is utilised to control rotation of the pickup arm to reorientate the outserts only during an intermediate portion of travel between linear motion at the extended and retractable positions.

It is an object of this invention to provide a label applying device in which labels are transferred from a label supplied to an article to which the label is to be applied by single label holding means and to reorientate the label in the transfer operation utilising a mechanism which is both simple but precise to ensure both reliable and accurate positioning of the label.

SUMMARY OF THE INVENTION

This invention provides a label applying device for applying adhesive labels to articles comprising; label holding means, means to supply labels one-by-one to the holding means oriented in one direction, a pad having a surface to receive a label, means to draw vacuum at the surface to hold a label on the surface and means to apply air pressure to the surface to propel the label from the pad onto a surface of an article, reciprocating support means to support the pad and to move the pad between a position adjacent the label holding means to receive a label to a label discharge position to discharge a label onto an article and means to rotate the pad with respect to the support means through a predetermined angle about an axis extending normal to the surface of the pad to enable a label received from the holding means to be positioned in the required orientation on said article, wherein the means to rotate the pad comprise a spindle having the pad mounted at one end thereof and mounted for rotation on the support means about an axis extending longitudinally of the spindle and pneumatically operated ram means drivingly engaged with the spindle to rotate the spindle in either direction about said axis and thereby re-orient a label received on the pad before delivering the label at said discharge position.

Said reciprocating means which supports and moves the pad between the label receiving position and the label discharging position may be arranged to maintain the pad in a horizontal attitude throughout said movement.

In one arrangement according to the invention the pad may be mounted at one end of a spindle rotatably mounted on the supporting means, and a pair of pneumatically operated racks may be mounted in the supporting means in driving engagement with a pinion on the spindle to rotate the spindle and with it the pad in opposite directions.

In any of the above arrangements the pad rotating means may be arranged to rotate the pad through an angle of 90° in one or other direction.

Also in any of the above arrangements means may be provided for adjusting the angle through which the pad is rotated between said respective receiving and discharge positions. For example the means for adjusting the angle of rotation of the pad comprise stop means for limiting the rotation of the pad in at least one direction.

More particularly the stop means may be associated with the means for rotating the pad and may comprise adjustable screw means mounted on the pad supporting means and in the path of the pad rotating means to limit the angles through which the pad rotating means rotates the pad.

Thus in the case where the pad rotating means comprises a pair of pneumatically operated racks mounted in the pad spindle means, the adjustable screw means may comprise a pair of screws mounted in the carrier in the paths of movement of the racks to provide end stops for limiting the movement of the racks and thereby the rotation of the pad.

Specifically, the pad rotating means may be arranged to rotate the pad through an angle of 90° in one or other direction.

BRIEF DESCRIPTION OF THE DRAWINGS

The following is a specific description of a specific embodiment of the invention, reference being made to the accompanying drawings in which.

DESCRIPTION OF THE PREPARED EMBODIMENTS

Figure 1:
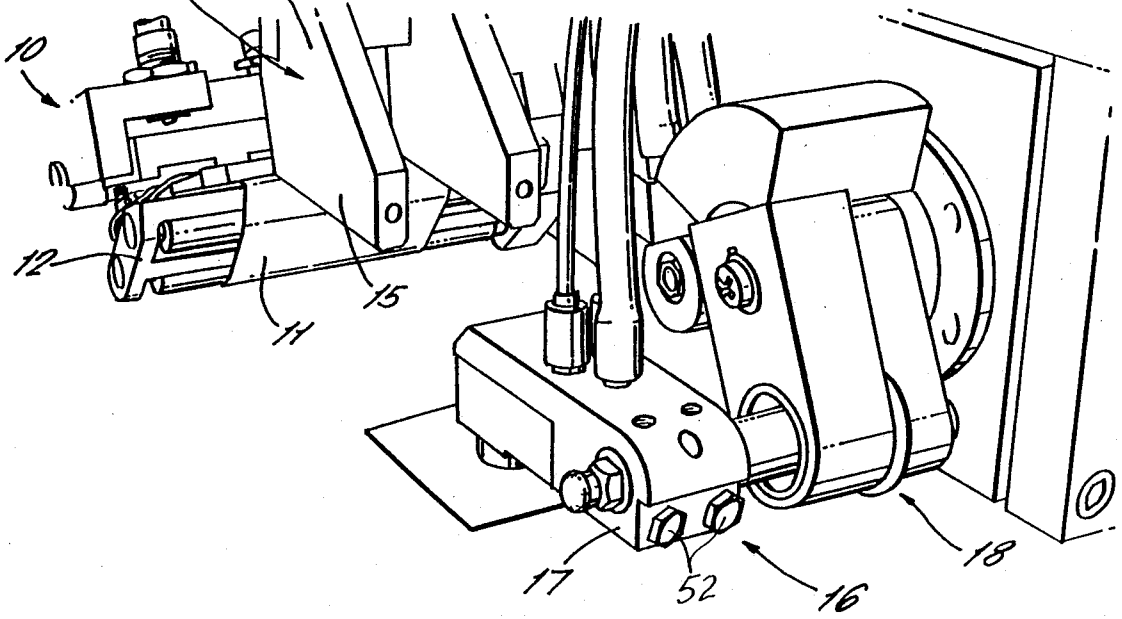
FIG. 1 is an elevation view of part of a label applying mechanism in a weigh/price labelling machine including a movable label applying head.
Figure 2:
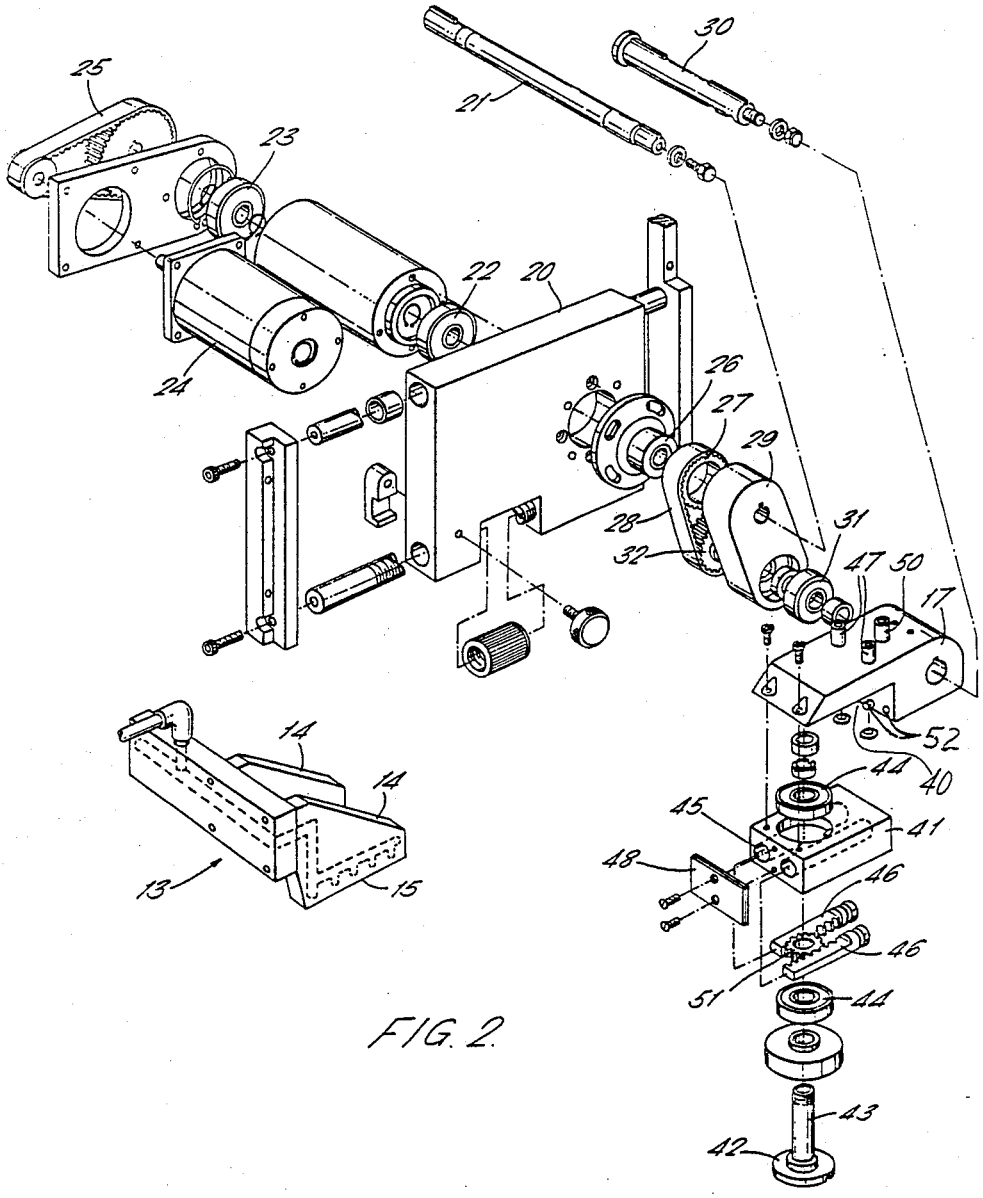
FIG. 2 is an exploded view of the components of the label applying head.
Figure 3:
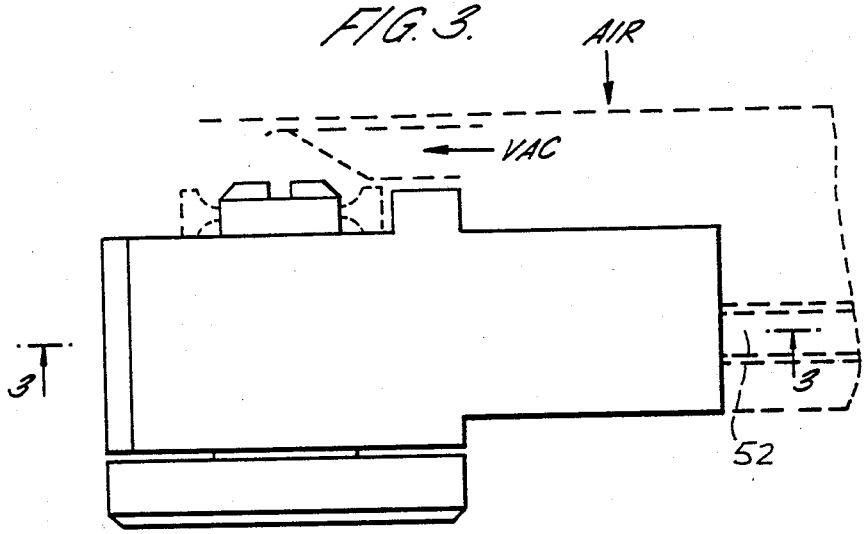
FIG. 3 is a side view of the label applying head.

Referring firstly to FIG. 1 of the drawings, there is shown a part of a labelling mechanism for a weigh/-price labelling apparatus comprising a device 10 which supplies printed self-adhesive labels on a backing strip 11. A stripper block 12 is provided around which the backing strip passes at an acute angle feeding the labels onto a temporary holder 13 for the label formed by a pair of spaced vertically extending parallel walls 14. The walls 14 terminate in downwardly facing edges 15 located immediately above the end of the stripper block 12 so that as a label is detached from the backing, it slides onto the edges 15. The edges 15 have spaced vacuum ports along the length thereof to hold temporarily the label to the edges.

A label transfer device is indicated at 16 and comprises a carrier 17 mounted for rotary movement on an eccentric drive mechanism indicated at 18. Rotation of the drive mechanism moves the carrier 17 from the label delivery position indicated in FIG. 1 through an annular path which extends downwardly between the walls 14 for the carrier to pick up a label supported at the lower ends thereof and thence downwardly to the label discharge position shown in FIG. 1.

The eccentric drive mechanism is mounted on a bracket 20 and comprises a first shaft 21 mounted in bearings 22 and 23 and driven by an electric motor 24 through a belt drive 25. The shaft 21 extends through a fixed hub 26 to which a toothed wheel 27 is keyed. An eccentrically extending housing 29 is keyed to the shaft 21 and an eccentric shaft 30 is mounted in the housing in a bearing 31. A toothed wheel 32 is keyed to the shaft 30 and is drivably connected to fixed toothed pinion 27 by a drive belt 28 at one end of the shaft 30 and the other end of the shaft is keyed to the carrier 17. Thus, rotation of the shaft 21 by the motor 24 rotates the carrier 17 through a circular path whilst maintaining a constant horizontal attitude.

Figure 4:
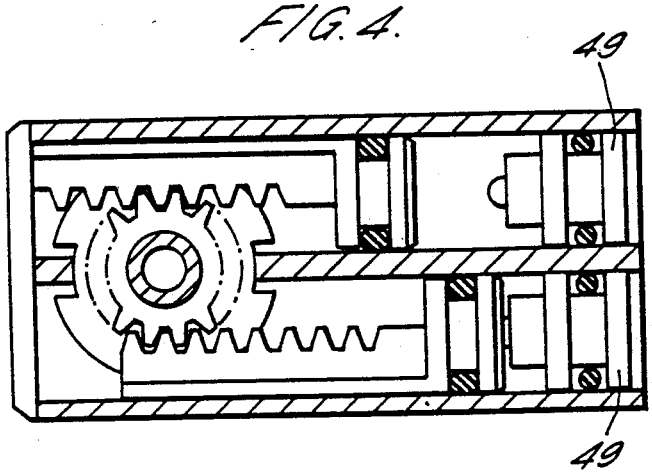
FIG. 4 is a section on the line 3—3 of FIG. 3.

The carrier 17 is formed with a recess 40 in which a rectangular block 41 is mounted. A pad 42 for receiving and applying labels to articles to be labelled is mounted at one end of a spindle 43 extending downwardly from the block. The spindle is supported in bearings 44 in the block for rotation about a vertical axis. The block has two parallel cylindrical bores 45 in which integral pistons/rack members 46 are reciprocatable. The rack/piston members engage either side of a toothed pinion 47 keyed to the spindle 43 which extends between the cylinders. The cylinders 45 are closed at one end of the carrier block 41 by an airplate 48 and at the other end by adjustable sealed plugs 49 as shown in FIG. 4. These plugs 49 and their associated screws 52 are adjustable screw means that lie in the paths of movement of the racks and act as end stops to limit the movement of the racks and the rotation of the pad. Air pressure is supplied to one or other of the cylinders 45 through ports 47 on the carrier 17 and appropriate passageways through the carrier to drive one or other pistons/racks to the end of its travel adjacent the plate 48 to reciprocate the spindle 43 and thereby the pad 42 in one or other direction. The extent of reciprocation can be adjusted by adjusting the end plug. In the particular arrangement shown, rotation of 90° is provided for the pad 42. A further port 50 is provided on the carrier for supplying air pressure to the pad 42 through passageways to the carrier and the spindle 43 to the pad surface to provide vacuum at the pad to hold the label to the pad or air pressure to the surface of the pad to discharge a label from the pad onto an article below the pad.

In operation, the reciprocating carrier rotates through the parallel walls 14 to collect a label supplied from the backing 11 and collects the label, vacuum being applied to the pad at that time. As the pad moves away from the walls, air pressure is supplied to one of the cylinders 46 to cause the pad to rotate through 90° to reorientate the pad for application of the label to an article. By the time the carrier reaches the label applying position, the 90° movement will have been completed. The vacuum is then cut off from the pad and a pressure pulse is supplied to the pad to discharge the label onto an article. Thus the label is reorientated from the attitude in which it has been collected from the temporary holder 13. As the carrier continues to move back towards the temporary holder, air pressure is supplied to the other cylinder of the block to return the pad to its original orientation.

It will be appreciated that the pad can be arranged to rotate in either direction and although the arrangement described above provides 90° of rotation, the extent of rotation can readily be set by appropriately designing the ram operated racks and pinion engaged therewith. It will also be appreciated that the pad can be operated selectively, that is it is not rotated if the label is received from the temporary holder correctly oriented to be applied to an article.

I claim:

1. A label applying device for applying adhesive labels to articles comprising; label holding means, means to supply labels one-by-one to the holding means oriented in one direction, a pad having a surface to receive a label, means to draw vacuum at the surface to hold a label on the surface and means to apply air pressure to the surface to propel the label from the pad onto a surface of an article, reciprocating support means to support the pad and to move the pad between a label receiving position adjacent the label holding means to receive a label to a label discharging position to discharge a label onto an article and means to rotate the pad with respect to the support means through a predetermined angle about an axis extending normal to the surface of the pad to enable a label received from the holding means to be positioned in the required orientation on said article, wherein the means to rotate the pad comprise a spindle having the pad mounted at one end thereof and mounted for rotation on the support means about an axis extending longitudinally of the spindle, pneumatically operated ram means drivingly engaged with the spindle to rotate the spindle in either direction about said axis and thereby re-orient a label received on the pad before delivering the label at said discharging position, said pneumatically operated ram means for rotating the spindle including a pair of pneumatically operated racks mounted in the support means, and a pinion provided on the spindle with which the racks are in driving engagement to rotate the spindle and with it the pad in opposite directions.

2. A labelling device as claimed in claim 1, wherein said reciprocating support means which supports and moves the pad between the label receiving position and the label discharging position maintains the pad in a horizontal attitude throughout said movement.

3. A label applying device as claimed in claim 1, wherein, the pad rotating means is arranged to rotate the pad through an angle of 90° in one or other direction.

4. A label applying device as claimed in claim 1, wherein, means are provided for adjusting the angle through which the pad is rotated between said respective receiving and discharging positions.

5. A label applying means as claimed in claim 4, wherein the means for adjusting the angle of rotation of the pad comprise stop means for limiting the rotation of the pad in at least one direction.

6. A label applying device as claimed in claim 5, wherein the stop means is associated with the means for rotating the pad and comprise adjustable screw means mounted on the reciprocating support means and in the path of the pad rotating means to limit the angles through which the pad rotating means rotates the pad.

7. A label applying device as claimed in claim 6 wherein the adjustable screw means are in the paths of movement of the racks to provide end stops for limiting the movement of the racks and thereby the rotation of the pad.

* * * * *